US006902408B2

(12) United States Patent
Yamane

(10) Patent No.: US 6,902,408 B2
(45) Date of Patent: Jun. 7, 2005

(54) COAXIAL ELECTRICAL CONNECTOR

(75) Inventor: Masahiro Yamane, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 10/745,687

(22) Filed: Dec. 29, 2003

(65) Prior Publication Data

US 2004/0137764 A1 Jul. 15, 2004

(30) Foreign Application Priority Data

Dec. 26, 2002 (JP) ..... 2002-378048
Oct. 30, 2003 (JP) ..... 2003-369808

(51) Int. Cl.[7] ..... H01R 12/00
(52) U.S. Cl. ..... 439/63; 439/944; 439/581
(58) Field of Search ..... 439/63, 944, 581

(56) References Cited

U.S. PATENT DOCUMENTS 4,645,288 A * 2/1987 Stursa ..... 439/581
6,074,217 A * 6/2000 Maruyama et al. ..... 439/63
6,474,995 B1 * 11/2002 Wu ..... 439/63
6,533,610 B1 * 3/2003 Dai et al. ..... 439/581
6,648,653 B2 * 11/2003 Huang et al. ..... 439/63

FOREIGN PATENT DOCUMENTS

JP 8-321361 12/1996

* cited by examiner

*Primary Examiner*—Ross Gushi
(74) *Attorney, Agent, or Firm*—Takeuchi & Takeuchi

(57) ABSTRACT

A coaxial electrical connector comprises an outer conductor (10) having a tubular section (11); a central conductor (20) having a contact section (21) extending in the axial direction in the tubular section (11); and a dielectric block (30) molded to hold together both the conductors (10, 20). The central conductor (20) has a radial section (22) extending outwardly in the radial direction from the bottom of the contact section (21) and a connection portion (23A) on the bottom face of the radial section (22) for contact with a circuit board. The central conductor 20 has a surface-processed portion so as to form at least one of a raised portion (24) and an indented portion (22A) and is in contact with the dielectric block at the surface-processed portion.

11 Claims, 11 Drawing Sheets

COAXIAL ELECTRICAL CONNECTOR

BACKGROUND OF THE INVENTION

1. Field of the Invention

The present invention relates to coaxial electrical connectors.

2. Description of the Related Art

Japanese Patent Application Kokai No. 8-321361 discloses a coaxial connector receptacle of this type.

As shown in FIGS. 16(A) and (B), this connector comprises a rectangular dielectric block 51 having a recessed section, a tubular outer conductor 52 having a substantially S-shaped cross-section in a plane including an axial line and provided on the recessed section, and a central conductor 53 having a contact section 54 that extends upwardly into the recessed section.

The central conductor 53 has a connection section 55 together with the contact section 54. The connection section 55 extends in a radial direction (FIG. 16(B)) and is flush with the bottom face of the dielectric block 51 so that when the connector is placed on the circuit trace of a circuit board, it is brought into contact with the trace and soldered for connection.

The central and outer conductors 53 and 52 are made by pressing a metal sheet and are held together by the molded dielectric block 51.

In the above connector, however, the joint between the dielectric block 51 and the central conductor 53, especially, its connection section 55 presents the following problems.

The thermal stress on soldering or plug-in/out forces make a gap between the dielectric block 51 and the connection section 55 or even separate them. In addition, upon soldering, the molten solder or flux (hereinafter simply "molten solder") can enter the gap. This molten solder can reach the contact section 54, making poor contact with a mating connector.

Since the connector must be low in profile, the bottom wall of the dielectric block is made so thin that it is prone to displacement by external forces or thermal expansion, making more gaps.

SUMMARY OF THE INVENTION

Accordingly, it is an object of the invention to provide a low-profile coaxial electrical connector that is able to prevent the molten solder from reaching the central conductor and permit the dielectric block to hold the central conductor sufficiently firmly to prevent displacement.

According to the invention there is provided a coaxial electrical connector comprising an outer conductor having a tubular section, a central conductor having a contact section that extends in the axial direction into the tubular section, and a dielectric block molded so as to hold together both the conductors. The central conductor has a radial section that extends outwardly in the axial direction from the bottom of the central conductor and has a connection portion extending from the radial section for contact with a circuit board.

The central conductor has a surface-processed portion so as to form at least one of a raised portion and an indented portion on a face that is in contact with the dielectric block so that it engages with the dielectric block at the surface-processed portion.

Since the central conductor is meshed with the dielectric block at the raised and/or indented portion, the gripping power of the central conductor by the dielectric block is improved. Consequently, the central conductor is hardly separated by external forces, and the soldering heat makes little gap between the dielectric block and the central conductor to prevent advancement of the molten solder into the gap.

It is preferred that the surface-processed portion is an indented portion formed on the bottom edge of the radial section and filled with part of the dielectric block. Consequently, the central conductor is embraced by the dielectric block with the improved retention power. Not only the width of the edge is so small that little influence is made on the area of the connection portion but also the length of the edge is so large that the strength is improved. The width of the edge that is filled with the dielectric block may be increased on the area that is not used as the connection portion.

The indented portion may be formed as a through-hole. The dielectric block fills the through-hole and holds the central conductor between the upper and lower portions, thereby improving the retention power.

The central conductor is made by bending and forming a metal sheet, and the surface-processed portion is made by a pressing process. Both the bending/forming and pressing processes may be done in the same step.

It is preferred that the central conductor engages with the dielectric block at the radial section.

The contact section is made hollow and filled with part of the dielectric block. In this case, the indented portion may be formed in the inside of the follow contact section.

The radial section has an extension portion extending outwardly in the radial direction beyond the outer conductor. It is preferred that a connection portion is provided on the bottom face of the extension portion and one of a ridge and a groove extends across the radial section on the top face in contact with the dielectric block.

Even if there is a small gap between the radial section and the dielectric block, the ridge or groove prevents the molten solder from passing through the gap to reach the contact section (labyrinth function). It is preferred that the ridge and groove extend in the circular direction so as to surround the base portion of the contact section of the central conductor.

The surface-processed portion is made by an embossing or stamping process.

The central conductor and the outer conductor is bottomed up from the bottom level of the connection portion of the central conductor in a circular area whose diameter is larger than the outside diameter of the connection section but smaller than the inside diameter of the outer conductor, forming a circular ridge on the bottom face of the dielectric block. The bottom face of the circular ridge is level with the bottom face of the connection portion. Consequently, the molten solder does not adhere to the central conductor in the circular area. Since the connection portion is so remote from the contact section that the molten solder is prevented effectively by that much.

The indented portion may be provided on the bottom face of the extension portion and filled with part of the dielectric block.

As described above, according to the invention, there is provided the surface-processed portion on the face of the central conductor that is in contact with the dielectric block so as to form at least one of the raised portion and the indented portion so that the retention and engaging forces of the central conductor by the dielectric block are improved but also the separation of the central conductor from the dielectric block is prevented, which eliminates adherence of the molten solder to the central conductor.

DESCRIPTION OF THE PREFERRED EMBODIMENTS

Embodiments of the invention will now be described with reference to FIGS. 1–15.

First Embodiment

Figure 1A:
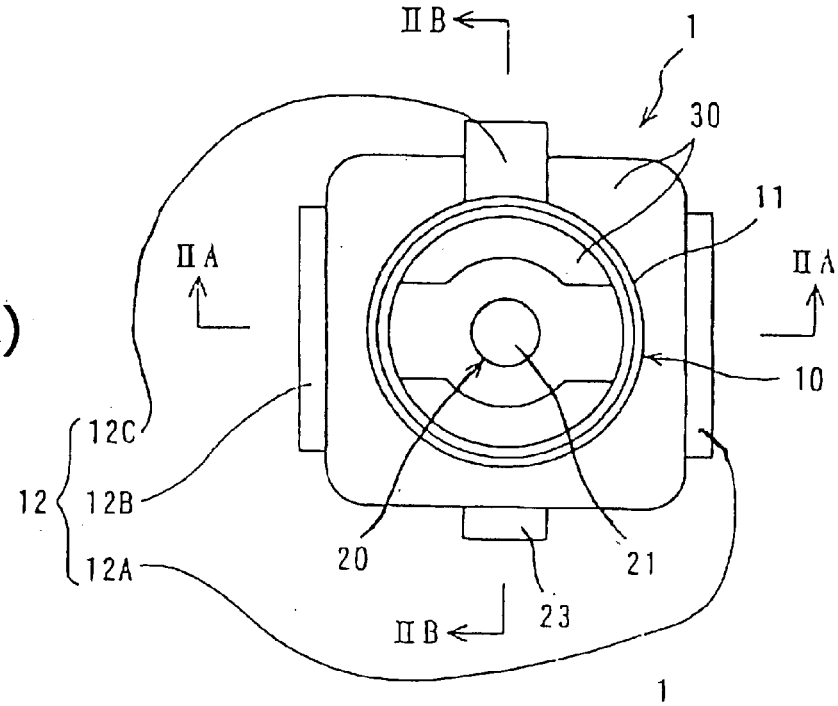
FIGS. 1(A), (B), and (C) are top, side, and bottom views of a coaxial electrical connector according to the first embodiment of the invention.
Figure 1B:
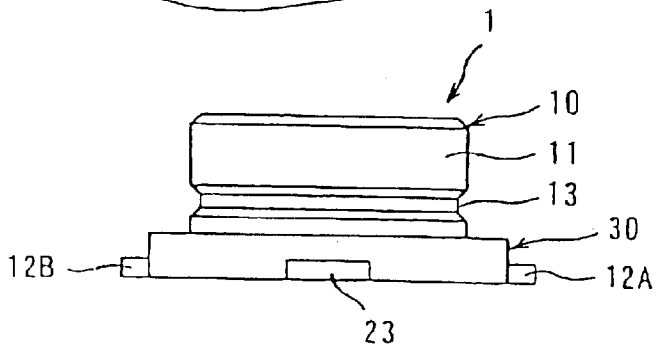
Figure 1C:
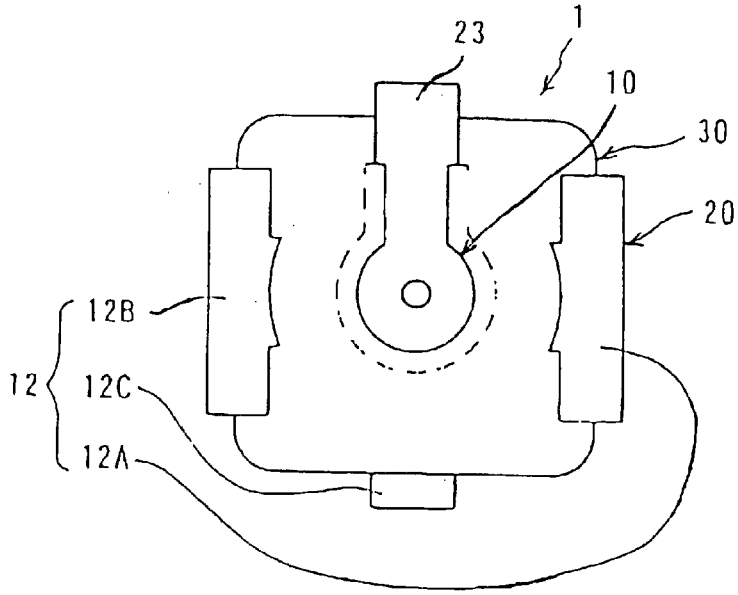
Figure 2A:
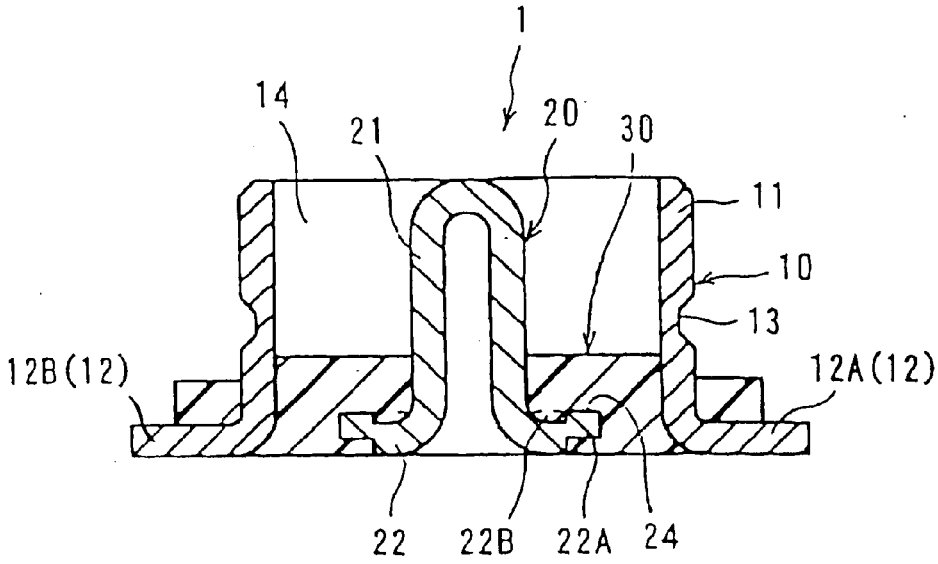
FIGS. 2(A) and (B) are sectional views taken along lines IIA—IIA and IIB—IIB of FIG. 1(A), respectively.
Figure 2B:
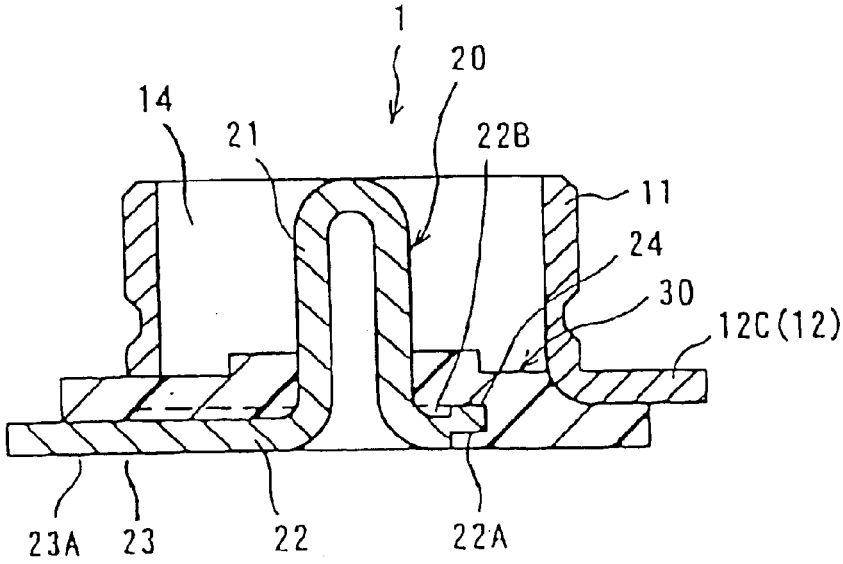

In FIGS. 1 and 2, a coaxial connector 1 according to the first embodiment comprises a dielectric block 30 that integrally holds an outer conductor 10 and a central conductor 20 as a unit.

The outer conductor 10 is made by bending and forming a metal sheet so as to provide a tubular section 11 having an axial line in the plugging direction with a mating connector and three leg sections 12 extending outwardly from the bottom of the tubular section 11. The tubular section 11 is provided with an engaging groove 13 for engagement with the outer conductor of a mating connector (not shown) for preventing separation. A pair of leg sections 12A and 12B, which are diametrically opposed to each other, are made relatively wide and the other leg section 12C is narrower than these two leg sections. The leg sections 12A and 12B are flush with the bottom face of the connector 1 so that when the connector is placed on a circuit board, they are brought into contact with the circuit traces. The leg section 12C, however, is positioned so as to make a gap between the circuit board and itself.

Figure 3A:
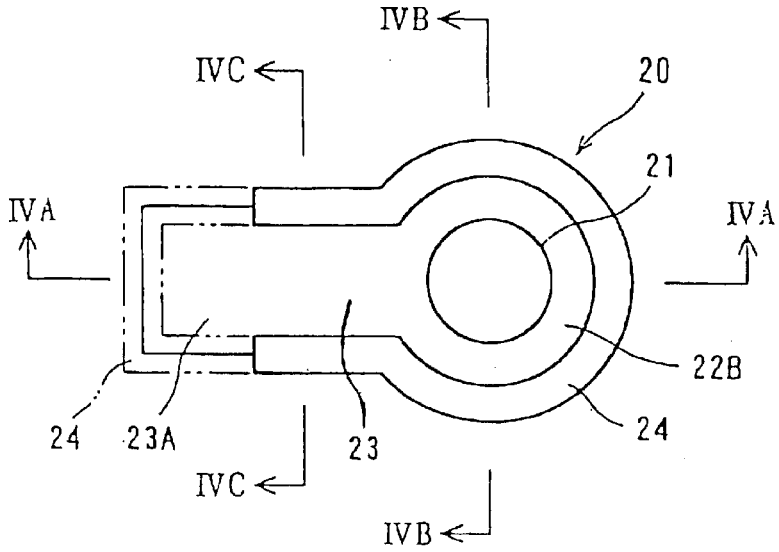
FIGS. 3(A), (B), and (C) are top, side, and bottom views of a central conductor for the connector.
Figure 3B:
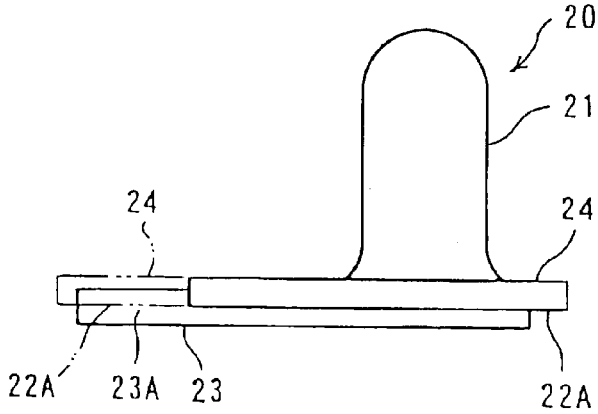
Figure 3C:
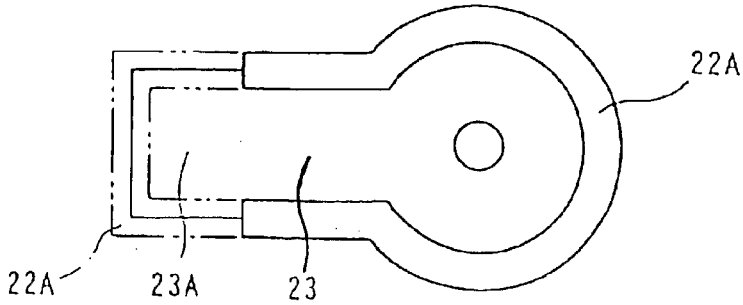
Figure 4A:
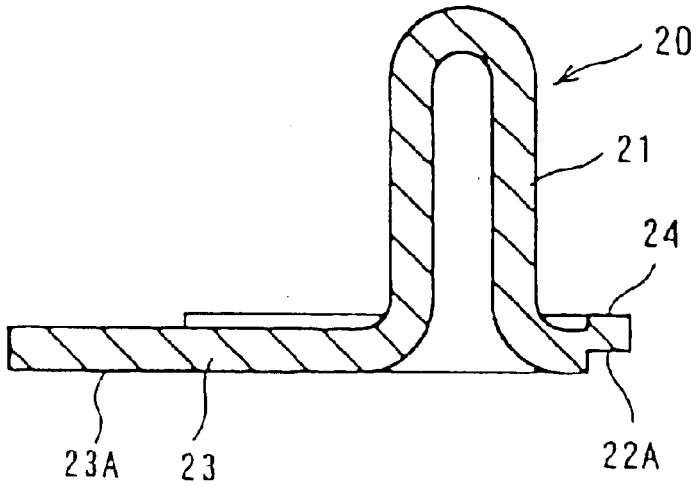
FIGS. 4(A), (B), and (C) are sectional views taken along lines IVA—IVA, IVB—IVB, and IVC—IVC of FIG. 3(A), respectively.
Figure 4B:
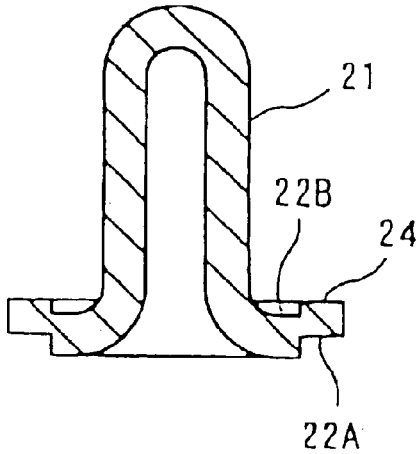
Figure 4C:
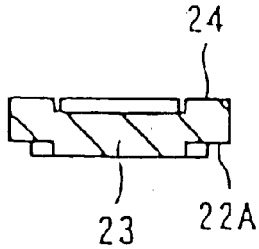

As shown in FIGS. 3 and 4, the central conductor 20 is made by bending and forming a metal sheet so as to provide a contact section 21 that extends in the axial direction and a radial section 22 that extends in a radial direction from the bottom of the contact section 21.

The contact section 21 is made by deep-drawing pressing a metal sheet so as to provide a hollow form having a semi-spherical tip and flared bottom that leads to the radial section 22. An extension portion 23 extends in a radial direction from part of the radial section 22 beyond the tubular section 11 of the outer conductor 10. The lower face of the extension portion 23 is flush with the circuit traces, forming a connection portion 23A.

Part of the edge of the radial section 22 is embossed so as to provide an indented portion 22A that is stepped up from the lower face of the extension portion 23. Consequently, there is provided a raised portion 24 on the position corresponding to the indented portion 22A. Both the indented portion 22A and the raised portion 24 surround the contact section 21 and a half of the extension portion 23.

The dielectric block 30 is made of a synthetic resin and molded together with the outer and central conductors 10 and 20 as a unit. It holds the central conductor 20 inside the tubular section 11 of the outer conductor 10 and the leg sections 12A, 12B, and 12C outside the tubular section 11, providing a receiving space 14 between the central and outer conductors 20 and 10 for receiving a mating connector. It has a rectangular shape outside the tubular section 11 (FIGS. 1(A) and (C)).

The dielectric block 30 enters the indented portion 22A of the central conductor 20 to support the radial section 22. Also, it enters the indented portion 22B defined by the raised portion 24 to increase the engaging power with the central conductor 20.

Thus, the central conductor 20 is held firmly by the dielectric block 30 by permitting the mold material to enter the indented portion 22A of the radial section 22. Consequently, it is held without failure by the dielectric block 30 when it receives the thermal stress on soldering or plugging-in/out forces in sue. In addition, even if there is a small gap between the radial section 22 and the dielectric block 30 upon soldering to a circuit board, the molten solder is prevented from reaching the contact section 21 by the indented portion 22A, the raised portion 24, and the indented portion 22B.

According to a modification to the embodiment, it is possible to extend the indented portion 22A and the raised portion 24. As shown in FIGS. 3(A) and (B), they are extended to the Left end of the extension portion 23 so as to surround the extension portion 23 as indicated by broken line. As shown in FIGS. 2(A) and (B), the dielectric block, 30 extends along the extension portion 23 so that when the raised portion 24 is extended, the engagement between the raised portion 24 and the dielectric block 30 is extended, improving the retention power. Furthermore, the raised portion 24 and the indented portion 22A at the left end of the extension portion 23, which is not in contact with the dielectric block 30, effectively prevent advancement of the molten solder.

Figure 5:
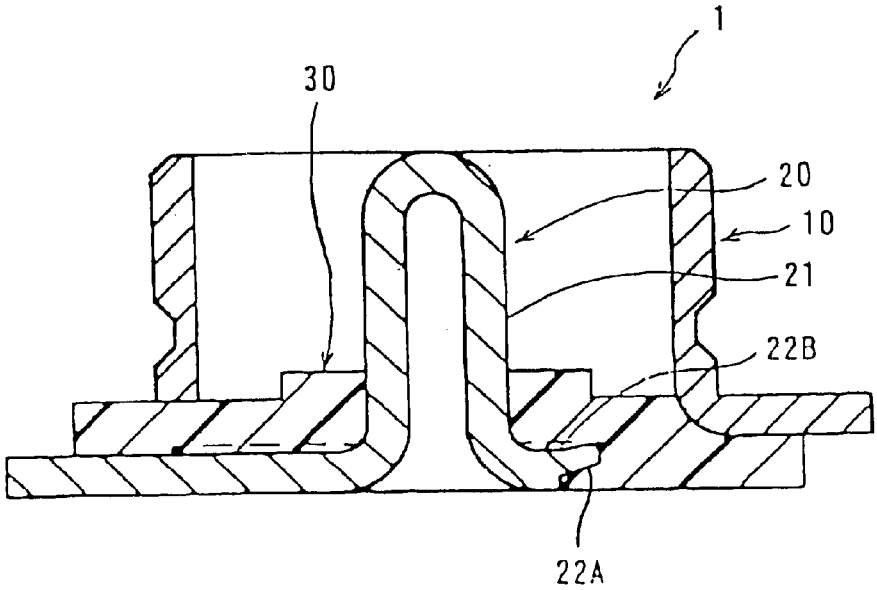
FIG. 5 is a sectional view of the first variation of the first embodiment.

As shown in FIG. 5, according to a variation to the embodiment, the indented portion 22A takes a tapered or tapered/stepped combination form. The thickness of the portion of the dielectric block 30 under the indented portion 22A gradually increases to provide more strength.

Figure 6:
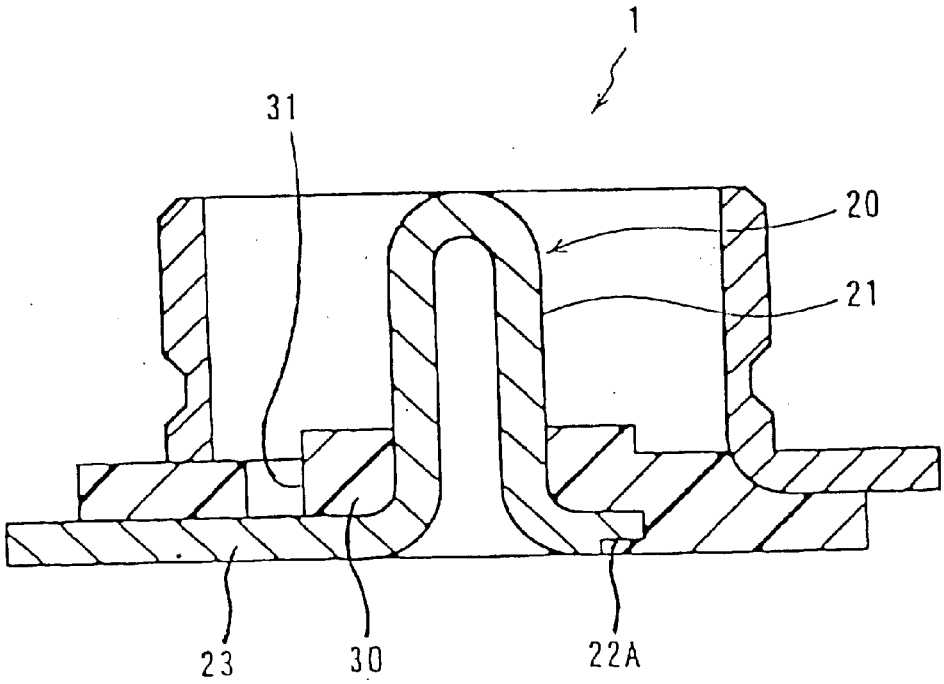
FIG. 6 is a sectional view of the second variation of the first embodiment.

As shown in FIG. 6, according to another variation to the embodiment, the fact that the indented portion 22A is provided on the edge of the radial section 22 is the same as the embodiment, but a through-hole 31 is provided in the dielectric block 30 on the extension portion 23.

Consequently, even if there is no embossed edge, the through-hole 31 prevents the molten solder from running along the extension portion 23 to the contact section 21.

Second Embodiment

Figure 7:
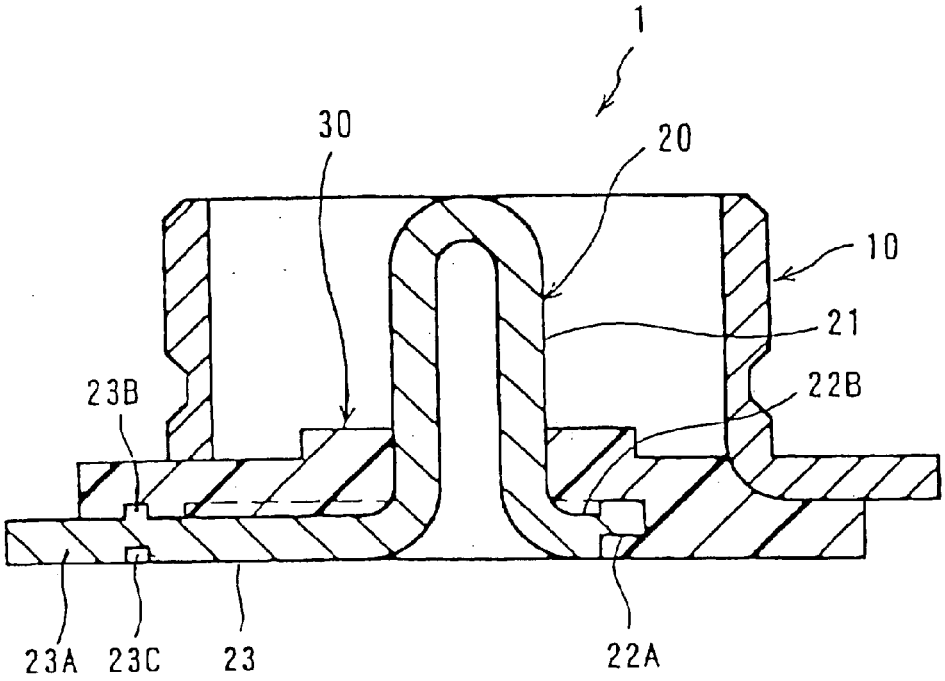
FIG. 7 is a sectional view of the second embodiment.

The second embodiment will be described with reference to FIG. 7. A ridge portion 23B extends in a widthwise direction of the extension portion 23 It is made by embossing a groove portion 23C under the ridge portion 23B. It is preferred that it extends across the entire or almost entire width of the extension portion 23. It not only increases the engaging power between the extension portion 23 and the dielectric block 30 but also prevents the molten solder from advancing beyond the ridge portion 23B even if there is a small gap between the extension portion 23 and the dielectric block 390. In order to provide this labyrinth effect, a recessed portion may be added to the ridge portion or to replace it. It may be replaced by a plurality of corrugations without the groove portion 23C. It not only has the labyrinth function but also increases the engaging power with the dielectric block 30. It is not necessary to be a narrow ridge but may be a wide ridge.

Third Embodiment

The third embodiment will be described with reference to FIGS. 8 and 9. Similarly to the first embodiment, there are provided on the edge of the radial Section 22 the indented portion 22A and the indented portion 22B that is defined by the raised portion 24 and filled with the dielectric block 30.

Figure 8:
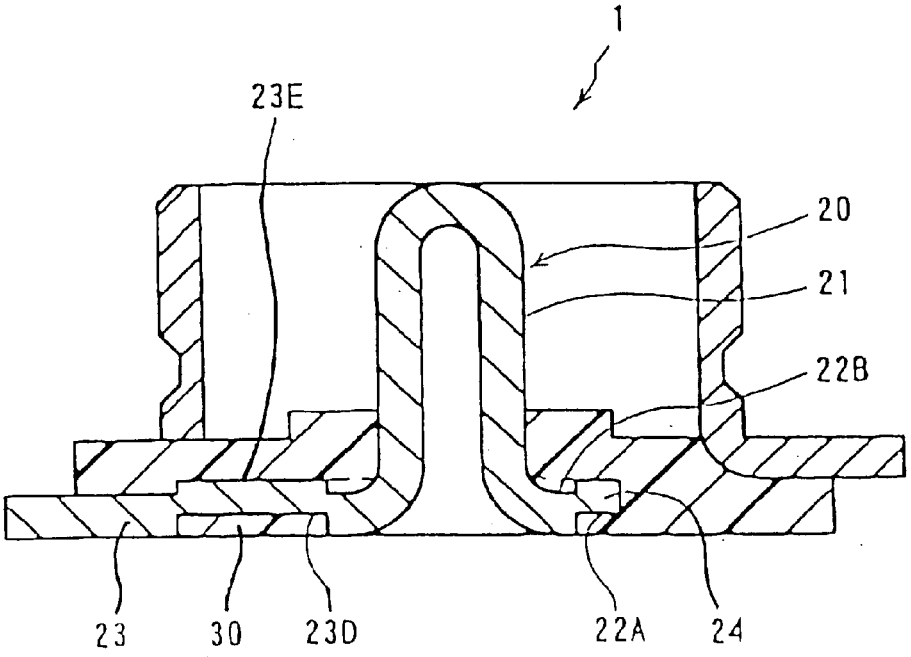
FIG. 8 is a sectional view of the third embodiment.

In FIG. 8, a wide indented portion 23D is provided in the extension portion 23 and filled with the dielectric block 31. The formation of the indented portion 23D provides a raised portion 23E. These wide indented and raised portions 23D and 23E increase the engaging power by the dielectric block 30. The raised portion 23E also improves the function of preventing advance of the molten solder.

Figure 9:
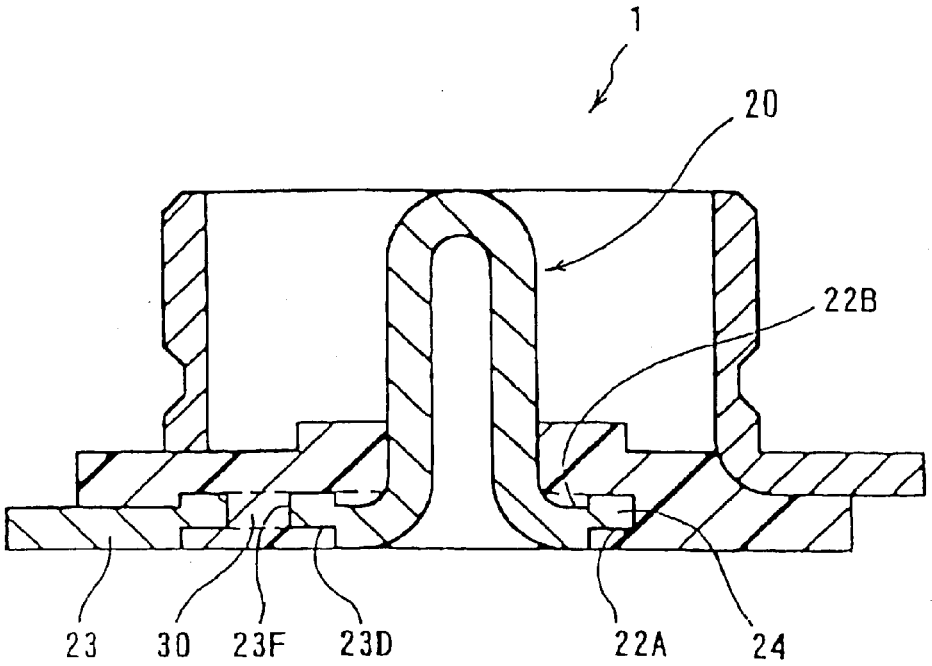
FIG. 9 is a sectional view of a variation of the third embodiment.

In FIG. 9, a through-hole 23F is provided in the extension portion 23 on the indented portion 23D so that the dielectric block 30 is connected through the through-hole 23F, This permits the dielectric block 30 holds the extension portion 23 between the upper and lower portions, improving the gripping power. Also, this makes the dielectric block 30 in the indented portion 23D stronger than that of FIG. 8.

Fourth Embodiment

Figure 10:
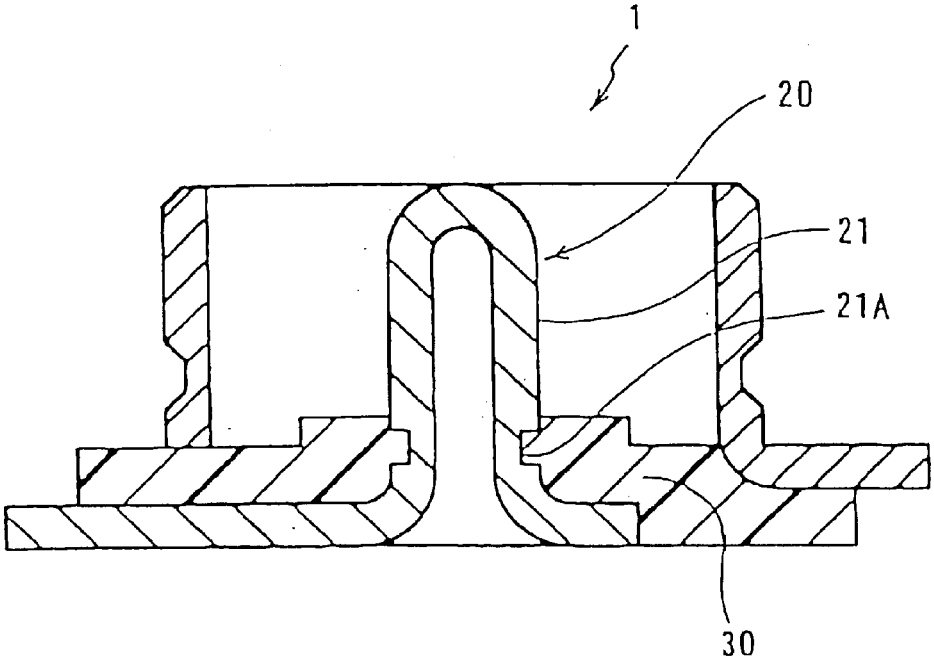
FIG. 10 is a sectional view of the fourth embodiment.
Figure 11:
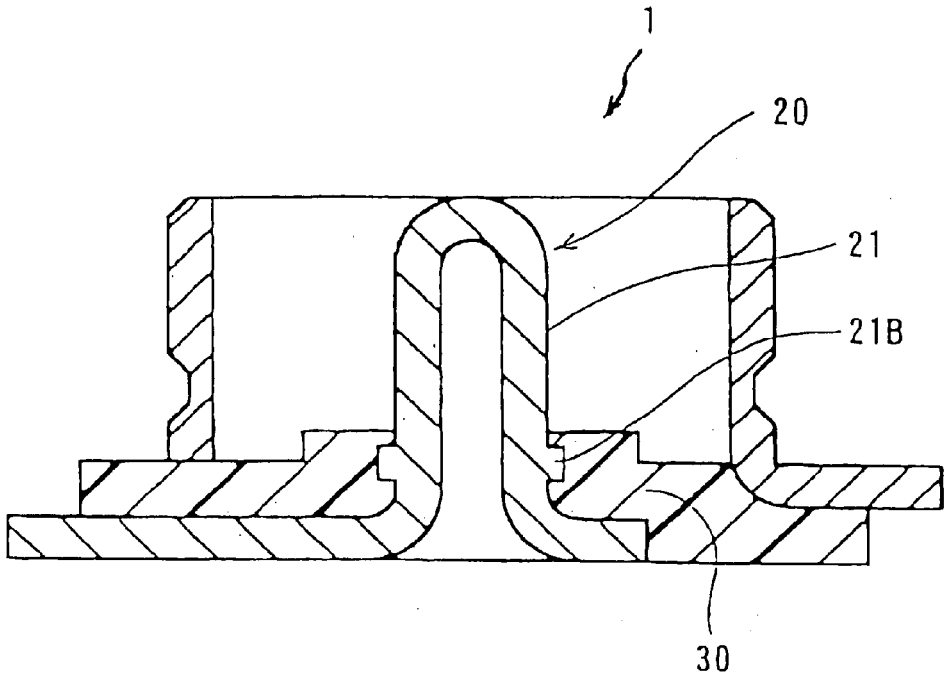
FIG. 11 is a sectional view of a variation of the fourth embodiment.

The fourth embodiment will be described with reference to FIGS. 10 and 11. It is characterized in that work is done on the contact portion 21 of the central conductor 20.

The contact section 21 is provided with a circular groove 21A (FIG. 10) or a circular ridge (FIG. 11) on its base portion to improve the engaging force or gripping power of the central conductor 20 by the dielectric block 30.

Also, both the circular groove 21A and the circular ridge 21B are able to prevent rising of the molten solder. A plurality of the circular grooves 21A and/or ridges 21B may be provided.

Fifth Embodiment

The fifth embodiment is described with reference to FIGS. 12 through 14. The gripping force of the central conductor 20 by the dielectric block 30 is improved outside the contact section 21 in the fourth embodiment, but it is improved inside the contact section 21 and/or below the radial section 22.

Figure 12:
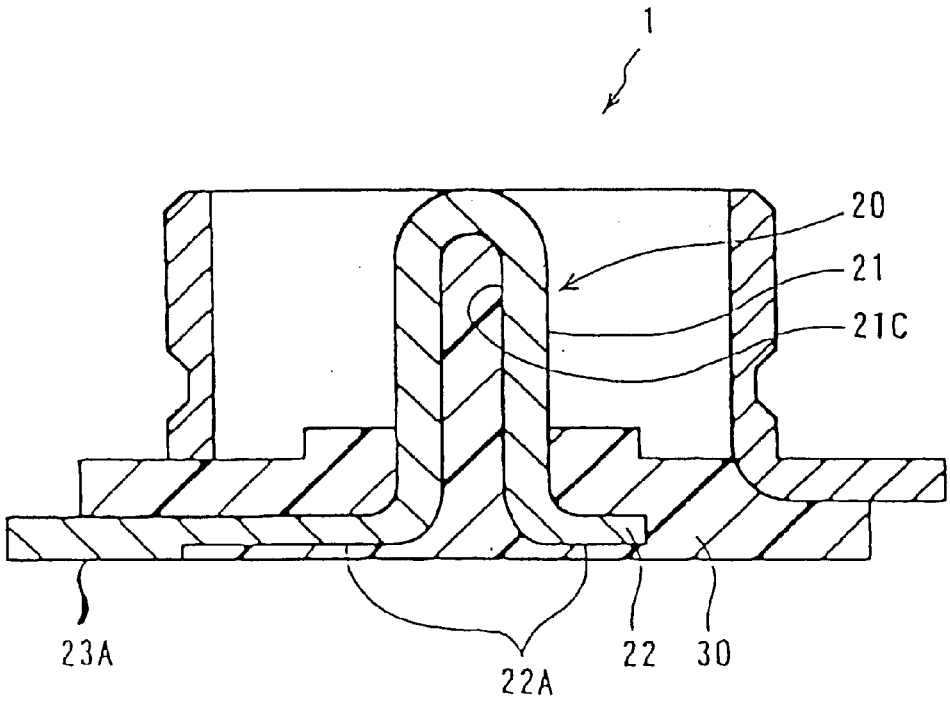
FIG. 12 is a sectional view of the fifth embodiment.

In FIG. 12, the hollow inside 21C of the contact section 21 is filled with the dielectric block 30, and the indented portion 22A is provided on almost all of the radial section 22 except for the connection portion 23A and filled with the dielectric block 30. The dielectric materials under the indented portion 22A and in the hollow inside 21C are connected to improve the strength of the dielectric block 30, thereby increasing the gripping power of the central conductor 20.

Figure 13:
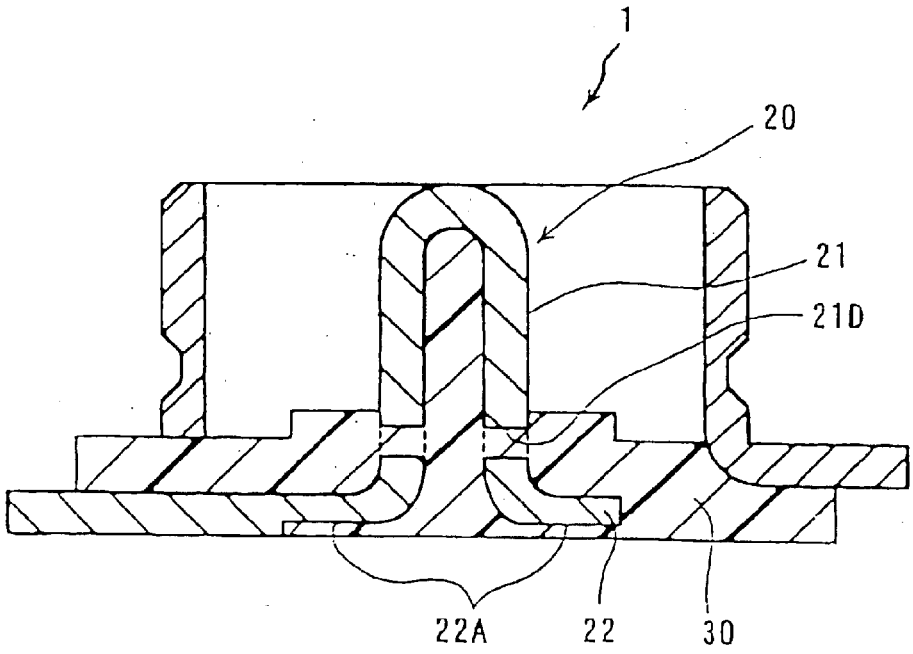
FIG. 13 is a sectional view of the first variation of the fifth embodiment.

In FIG. 13, a through-hole 21D is provided in the base portion of the contact section 21 to connect the dielectric materials insides and outside the contact section 21 for improving the engaging force between the dielectric block 30 and the central conductor 20. Also, the through-hole 21D prevents passage of the molten solder. A plurality of the through-holes 21D may be provided.

Figure 14:
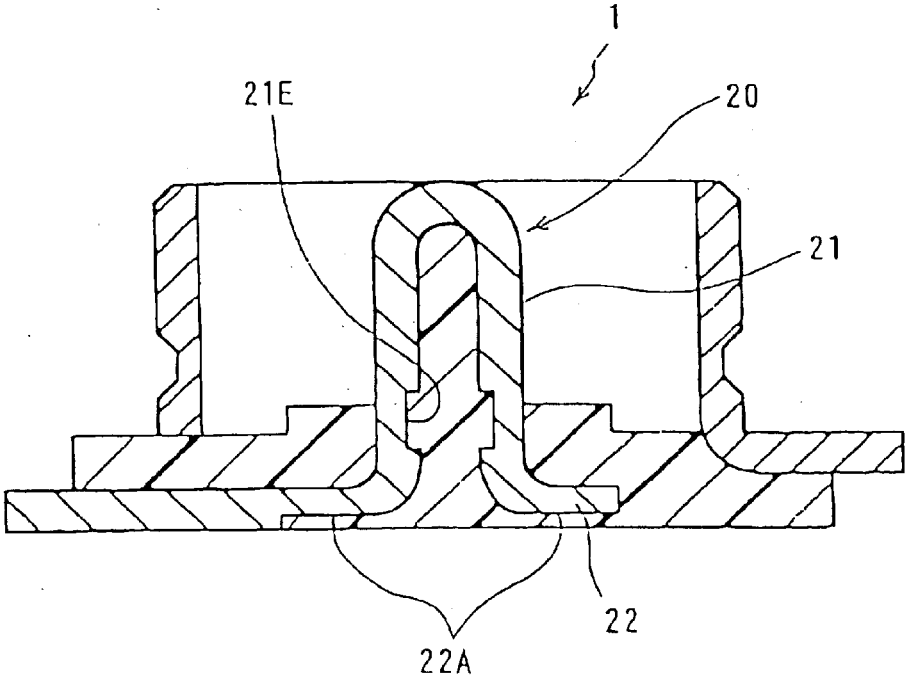
FIG. 14 is a sectional view of the second variation of the fifth embodiment.

In FIG. 14, a circular groove 21E is provided on the inside of the contact section 21 to improve the engaging force of the dielectric block 30. The loss of strength of the contact section 21 is smaller in FIG. 14 than in FIG. 13. A plurality of the circular grooves 21E may be provided.

Sixth Embodiment

Figure 15A:
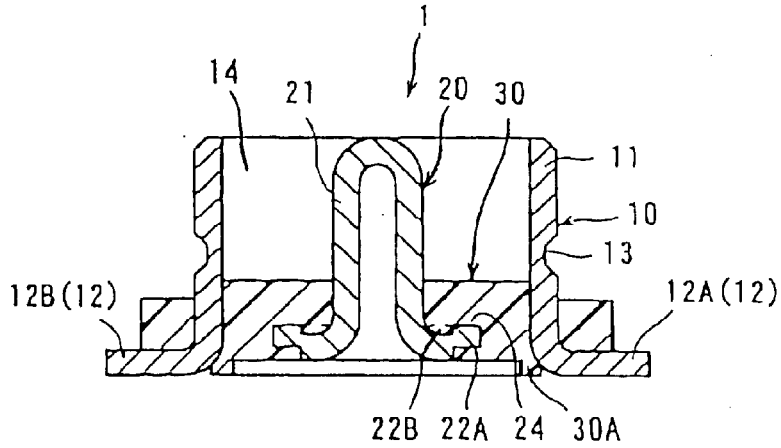
FIGS. 15(A) and (B) are sectional views and (C) a bottom view of the sixth embodiment.
Figure 15B:
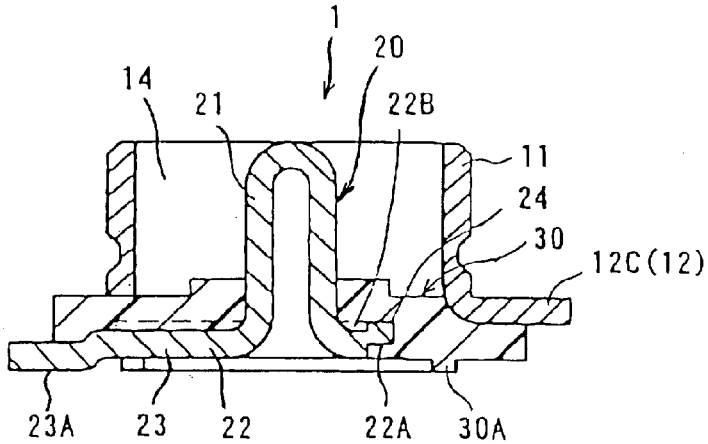
Figure 15C:
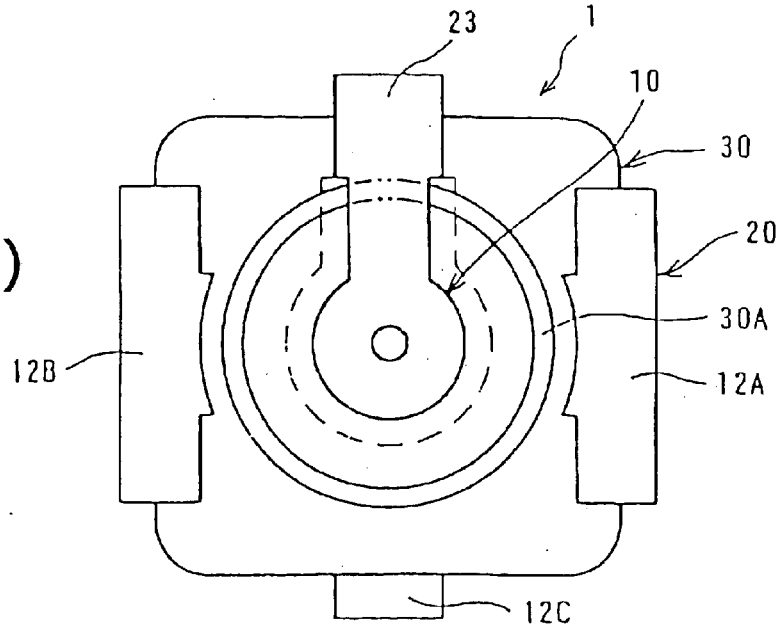
Figure 16A:
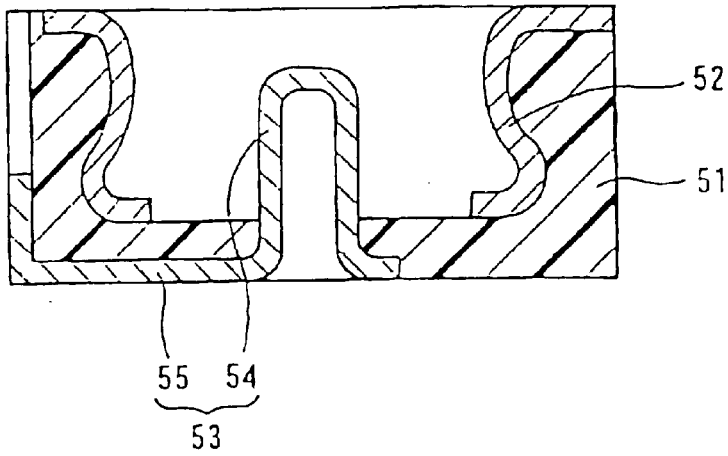
FIGS. 16(A) and (B) are sectional and bottom views of a conventional connector.
Figure 16B:
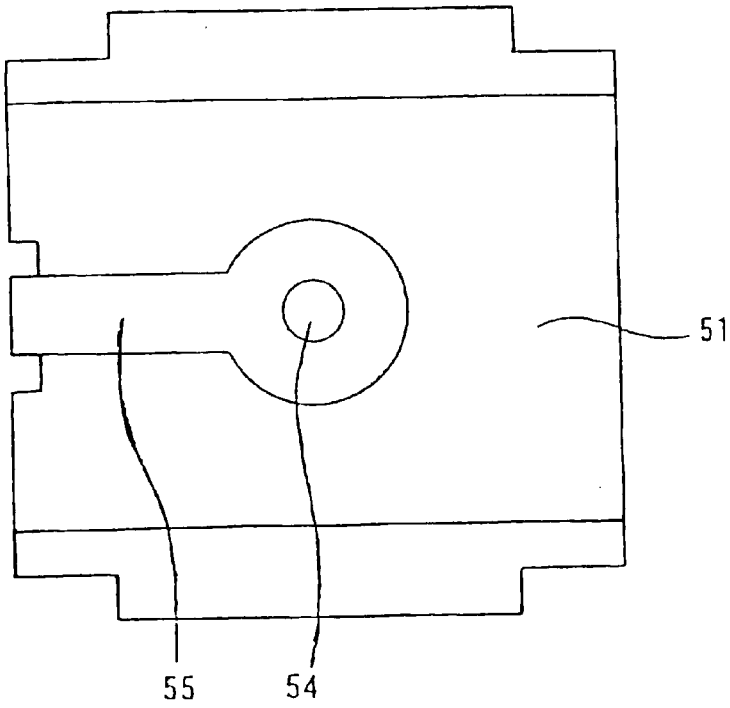

The sixth embodiment in FIGS. 15(A)–(C) controls movement of the molten solder under the dielectric block 30 more effectively than that of the first embodiment in FIGS. 1 and 2.

FIGS. 15(A) and (B) are sectional views corresponding to FIGS. 2(A) and (B), and FIG. 15(C) is a bottom view of the connector.

The lower faces of the radial section 22 and the dielectric block 30 are set at a slightly higher position than the lower faces of the connection portion 23A of the central conductor 20 and the connection sections 12A and 12B of the outer conductor 10.

A substantially closed circular ridge 30A is. provided on the bottom face of the dielectric block 30 around the central conductor 20, and its bottom face is substantially flush with the connection portions 12A and 12B of the outer conductor 10 and the connection portion 23A of the central conductor 20. The circular ridge 30A is not completely closed but satisfactory. As shown in FIG. 15(C), there is no circular ridge 30A in the area corresponding to the extension portion 23, forming an open circle. As indicated by broken line, the ridge may be provided on the extension portion 23 to provide a completely closed circular ridge.

According to the embodiment, the circular ridge prevents advance of the molten solder to the radial section more effectively than the first embodiment of FIGS. 1 and 2.

The invention is not limited to the illustrated embodiments and variations but a variety of modifications may be made. For example, the central conductor may be made by cutting and grinding instead of bending and forming or a combination of these.

What is claimed is:

1. A coaxial electrical connector to be connected to a circuit board, said electrical connector comprising:

an outer conductor having a tubular section;

a central conductor having a contact section that extends in an axial direction within said tubular section;

a dielectric block molded so as to hold together said outer and central conductors as a unit;

a radial section extending outwardly from a bottom of said contact section;

an extension section extending from said radial section in a radial direction and ending at a connection portion for contact with said circuit board; and at least one surface-processed portion consisting of an indented portion that extends around a bottom edge of said radial section and up to a middle point of said extension section and a raised portion that extends around a top edge of said radial section and up to said middle point of said extension section corresponding to said indented portion.

2. The coaxial electrical connector according to claim 1, wherein said central conductor engages with said dielectric block at least at said radial section.

3. The coaxial electrical connector according to claim 1, which further comprises an extension portion that extends from said radial section in a radial direction beyond said outer conductor and has said connection portion provided on a bottom face and said surface-processed portion provided on a top face and extending in a direction perpendicular to said radial direction.

4. The coaxial electrical connector according to claim 1, wherein said surface-processed portion is made by an embossing process.

5. The coaxial electrical connector according to claim 1, wherein said central conductor and said dielectric block have a bottom face higher than a bottom face of said connection portion of said central conductor on a circular area whose diameter is larger than an outside diameter of said contact section but smaller than an inside diameter of said outer conductor, forming a circular ridge on a bottom of said dielectric block, whose bottom is flush with said bottom face of said connection portion.

6. The coaxial electrical connector according to claim 1, wherein said radial section is provided with an extension portion that extends in said radial direction beyond said outer conductor and has an indented portion on its bottom face filled with part of said dielectric block.

7. The coaxial electrical connector according to claim 1, wherein said surface-processed portion is filled with part of said dielectric block.

8. The coaxial electrical connector according to claim 7, wherein a through-hole is provided in said indented portion.

9. The coaxial electrical connector according to claim 1, wherein said central conductor is made by bending and forming a metal sheet and said surface-processed portion is made by press.

10. The coaxial electrical connector according to claim 9, wherein said contact section is made hollow and filled with part of said dielectric block.

11. The coaxial electrical connector according to claim 10, wherein said indented portion further includes a second indented portion inside of said hollow.

* * * * *